US006463247B1

(12) United States Patent
Kawano et al.

(10) Patent No.: US 6,463,247 B1
(45) Date of Patent: Oct. 8, 2002

(54) COLOR IMAGE FORMATION APPARATUS USING PLURAL PHOTOSENSITIVE DRUMS

(75) Inventors: Yuzo Kawano, Ogori; Masaya Shimada, Onojo; Kohei Suyama, Kurume, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 39 days.

(21) Appl. No.: 09/591,502

(22) Filed: Jun. 12, 2000

(30) Foreign Application Priority Data

Jun. 15, 1999 (JP) ..... 11-167911
Jun. 15, 1999 (JP) ..... 11-167912
Jun. 23, 1999 (JP) ..... 11-176464

(51) Int. Cl.[7] ..... G03G 15/01
(52) U.S. Cl. ..... 399/299
(58) Field of Search ..... 399/299, 306, 399/303, 313, 296

(56) References Cited

U.S. PATENT DOCUMENTS 5,309,203 A * 5/1994 Hokari ..... 399/303
5,469,248 A * 11/1995 Fujiwara et al. ..... 399/314
5,678,150 A * 10/1997 Takahashi et al. ..... 399/299
5,983,041 A * 11/1999 Otaki et al. ..... 399/296
6,021,287 A * 2/2000 Tanaka ..... 399/66
6,097,922 A * 8/2000 Munenaka ..... 399/312
6,134,402 A * 10/2000 Nakayama et al. ..... 399/101

FOREIGN PATENT DOCUMENTS

JP 06-308840 * 11/1994
JP 11002935 A * 1/1999 ..... G03G/15/01

* cited by examiner

*Primary Examiner*—Robert Beatty
(74) *Attorney, Agent, or Firm*—Stevens, Davis, Miller & Mosher, LLP

(57) ABSTRACT

An image formation apparatus comprises photosensitive drums for respectively forming toner images corresponding to specified colors of an original image, an intermediate transfer belt onto which the toner images are transferred from the photosensitive drums in superimposed relation to form a synthetic toner image, and transfer rollers each for pressing the intermediate transfer belt against the associated photosensitive drum. The photosensitive drum disposed more upstream in a direction of conveyance of the intermediate transfer belt has a lower speed. The intermediate transfer belt may be designed to move at a speed higher than those of the photosensitive drums. With this construction, a sag or dip of the intermediate transfer belt between any two adjacent photosensitive drums is eliminated, thereby preventing a color drift of the synthetic toner image.

8 Claims, 5 Drawing Sheets

COLOR IMAGE FORMATION APPARATUS USING PLURAL PHOTOSENSITIVE DRUMS

BACKGROUND OF THE INVENTION

1. Field of the Invention

This invention relates to an image formation apparatus capable of forming a synthetic image by superimposing image informations, using electrophotography or the like.

2. Description of the Related Art

In a conventional image formation apparatus using electrophotography, an electrophotographic photosensitive member, serving as an image-carrying member, is charged by a static charger, and light is applied to this photosensitive member in accordance with image information to form a latent image, and this latent image is developed by a developing device to form a toner image, and the formed toner image is transferred to a sheet or the like, thus forming the image.

On the other hand, with the advent of color images, there has been proposed an image formation apparatus of the tandem type in which a plurality of image-carrying members are provided, each of which is for effecting such an image-forming process, and color images, that is, a cyan image, a magenta image, a yellow image and preferably a black image, are formed on the respective image-carrying members, and these color images are transferred at respective transfer positions of the image-carrying members to a sheet in a superimposed manner, thereby forming a full-color image.

Such an image formation apparatus of the tandem type, because of the plurality of image-forming portions for forming the color images, is advantageous for a high-speed operation. What is important is to satisfactorily effect the registration in position of the color images formed by the different image-forming portions.

The reason is that a misregistration of the four color images, transferred to the sheet, results in a color drift or a variation in color tone.

FIG. 8 shows a conventional image formation apparatus using four photosensitive drums.

As shown in FIG. 8, the image formation apparatus comprises the photosensitive drums (photosensitive members) 51 for respectively forming toner images of four colors, for example, black (K), yellow (Y), magenta (M) and cyan (C), which drums serve as image-carrying members, and toner image-forming members 3 for forming the toner images on the surfaces of the photosensitive drums 51, respectively.

The toner image-forming member 3 comprises a charger 11 for charging the surface of the photosensitive drum 51 with electricity, an exposure device 12 for forming an electrostatic latent image, corresponding to specified color image data, on the charged photosensitive drum 51, a developing device 13 for developing the electrostatic latent image, a first transfer roller 21, which has an elastic material, e.g. an electrically-conductive urethane sponge, formed on a surface thereof, and urges an intermediate transfer belt 52 toward the photosensitive drum 51 so as to transfer the toner image, developed on the surface of the photosensitive drum 51, to the intermediate transfer belt 52, and a cleaner 14 for removing the residual toner remaining on the photosensitive drum 51 after the transfer of the toner image to the intermediate transfer belt 52.

The intermediate transfer belt 52, arranged along the plurality of photosensitive drums 51, are supported by a drive roller 20, a driven roller 22 and a tension roller 28, and is revolved in a direction of arrow A. An intermediate transfer belt cleaner 27 for removing the residual toner, remaining on the surface of the intermediate transfer belt 52, is provided adjacent to this belt 52. A color drift sensor 29 for detecting the amount of a color misregistration or drift of the toner images on the intermediate transfer belt 52 is provided adjacent to the intermediate transfer belt 52.

A paper cassette 15, storing printing paper 7, is provided at a lower portion of the apparatus, and the printing paper sheets 7 are fed one by one into a path of feed of the paper by a feed roller 16.

Resist rollers 17 for controlling the transfer timing for the printing paper 7, a second transfer roller 10 for transferring the color image, formed on the intermediate transfer belt 52, to the printing paper 7, and a fixing device 40 for fixing the transferred color image to the printing paper 7 by a fixing roller 18 and a pressure roller 19 are provided in the paper feed path.

In the image formation apparatus of this construction, for example, a latent image of a black color component of image information is first formed on the photosensitive drum 51 corresponding to the black color. This latent image is formed into a visible image, serving as a black toner image, by the developing device 13, and this black toner image is transferred onto the intermediate transfer belt 52 by the first transfer roller 21.

During this operation, a latent image of a cyan color component of the image information is formed on the photosensitive drum 51 corresponding to the cyan color, and this latent image is developed as a cyan toner image by the developing device 13, using a cyan toner. Then, the cyan toner image is transferred by the first transfer roller 21 onto the intermediate transfer belt 52, to which the black toner image has already been transferred, in superimposed relation to this black toner image.

Subsequently, a magenta toner image and a yellow toner image are formed in the same manner as described above, and thus the toner images of the four colors are superimposed together on the intermediate transfer belt 52.

On the other hand, the printing paper 7 is fed from the paper cassette 15 by the feed roller 16, and the toner images of the four colors are transferred at a time onto the printing paper 7, controlled in transfer timing by the resist rollers 17, by the second transfer roller 10. The thus transferred toner images are heated and fixed to the printing paper 7 by the fixing roller 18 and the pressure roller 19, so that a full-color image is formed on this printing paper 7.

The residual toner is removed from each of the photosensitive drums 51 by the cleaner 14 after the transfer of the toner image therefrom is finished.

In the above conventional construction, each transfer roller 21 is rotatably supported beneath the corresponding photosensitive drum 51, with the intermediate transfer belt 52 held therebetween. The outer diameter of the transfer roller 21, defined by the outer peripheral surface thereof, changes with the lapse of time, so that the force of pressing of the intermediate transfer belt 52 against the transfer roller 21 gradually decreases. Therefore, taking this into consideration, the force of pressing of the transfer roller 21 against the intermediate transfer belt 52 has beforehand been set to a little higher value.

And besides, the toner image is transferred from each photosensitive drum 51 to the intermediate transfer belt 52, and therefore the intermediate transfer belt 52 and the photosensitive drum 51 stand in contact with each other while maintaining the surface potential of the photosensitive drum 51.

Furthermore, the intermediate transfer belt 52 is pressed into the surface of each photosensitive drum 51 by the elastic force of the elastic material formed on the surface of the first transfer roller 21.

Furthermore, because of manufacturing errors such as a variation in the outer diameter and the eccentricity of the rotation axis, the peripheral speed of the photosensitive drum 51 deviates from the predetermined speed, so that the speed difference develops between the photosensitive drum 51 and the intermediate transfer belt 52.

Because of these factors, a dip or sag due to an electrical attracting force develops in the intermediate transfer belt 52 between any two adjacent photosensitive drums 51, and the belt distances between the adjacent photosensitive drums 51, that is, the belt distance between K and Y, the belt distance between Y and M and the belt distance between M and C, are varied, and this causes a deviation in the timing of transfer from each photosensitive drum 51 to the intermediate transfer belt 52.

As a result, a misregistration of the toner images, transferred to the intermediate transfer belt 52, occurs, and this appears as light and shade due to a color drift, which has invited a problem that the picture quality has been greatly degraded.

This problem has been a very big barrier to the formation of an image of a high picture quality with no color misregistration or drift in a digital-color image formation apparatus.

SUMMARY OF THE INVENTION

It is therefore an object of this invention to provide an image formation apparatus in which a dip or sag of an intermediate transfer belt between adjacent ones of a plurality of photosensitive members is reduced by decreasing a speed variation of the intermediate transfer belt due to a speed variation of the photosensitive members.

In order to achieve the above object, the image formation apparatus of the invention has a construction wherein each of transfer rollers, which are disposed below an intermediate transfer belt to press the intermediate transfer belt toward respective photosensitive drums, is resiliently provided at a position different from a point of contact between the associated photosensitive drum and the intermediate transfer belt, thereby adjusting the force of pressing of the intermediate transfer belt against the photosensitive drum.

The image formation apparatus according to another aspect of the invention has a construction wherein there is provided a device for removing or neutralizing an electric charge of each photosensitive drum or the intermediate transfer belt so as to reduce an electrostatic attracting force acting between the intermediate transfer belt and the photosensitive drum.

The image formation apparatus according to still another aspect of the invention has a construction wherein the peripheral speed of the intermediate transfer belt is set higher than the peripheral speeds of the photosensitive drums.

With those constructions, a frictional contact force between the intermediate transfer belt and each photosensitive drum is adjusted so that a slip can develop between the intermediate transfer belt and the photosensitive drum, and therefore a sag or dip is prevented from occurring in the intermediate transfer belt, thereby preventing a color misregistration or drift.

DESCRIPTION OF THE EMBODIMENTS

Figure 1:
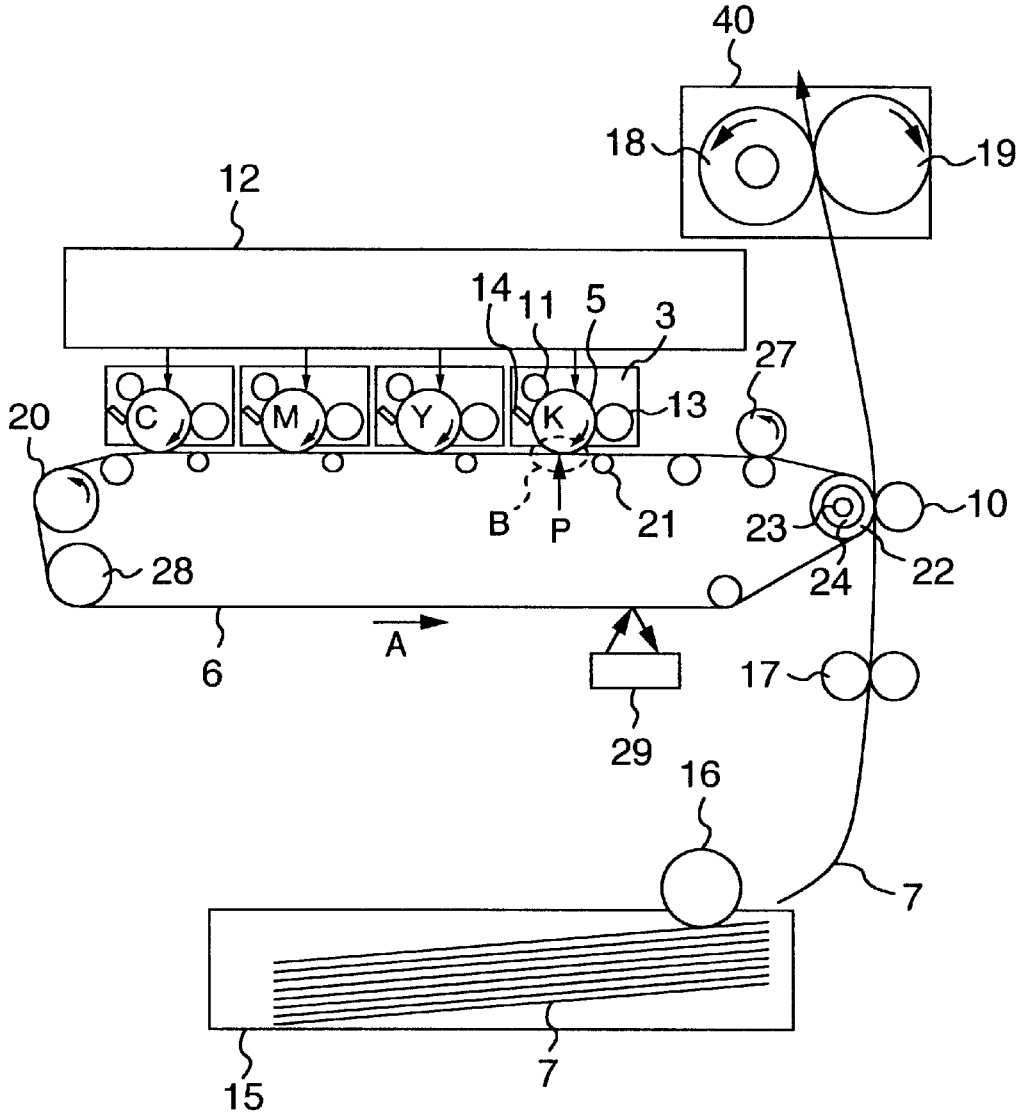
FIG. 1 is a schematic view showing an image formation apparatus according to an embodiment of the invention.

An embodiment of the present invention will now be described with reference to FIGS. 1 to 4. In these Figures, identical reference numerals denote identical members, respectively, and repeated explanation thereof will be omitted.

Figure 2:
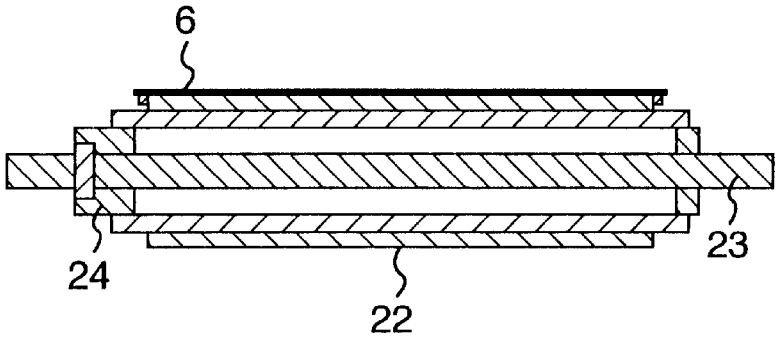
FIG. 2 is an axial cross-sectional view of a driven roller used in the image formation apparatus.
Figure 3:
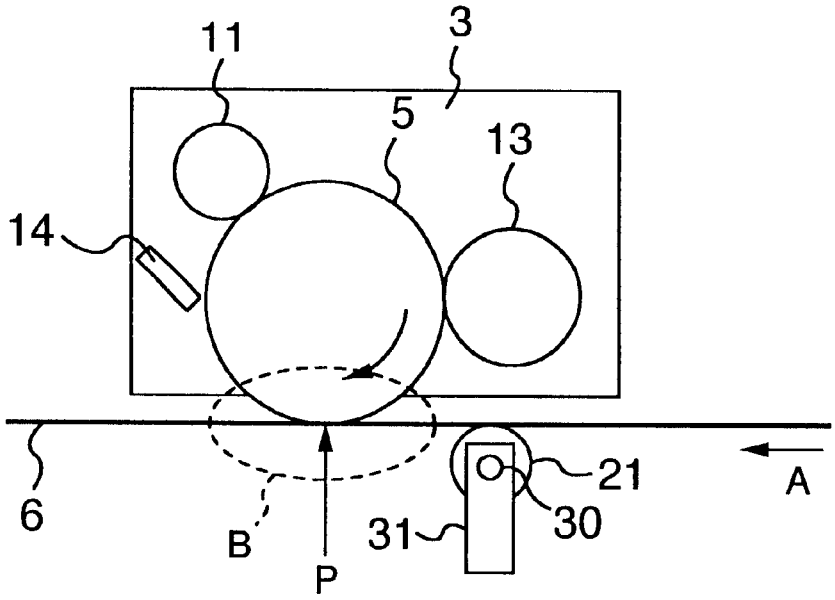
FIG. 3 is an enlarged view of a toner image-forming member used in the image formation apparatus.
Figure 4:
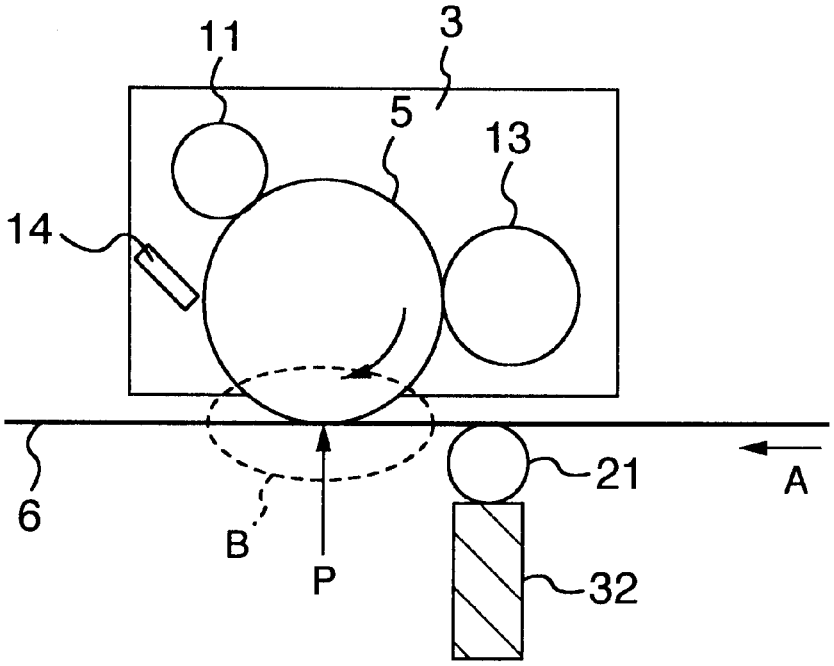
FIG. 4 is an enlarged view of the toner image-forming member used in the image formation apparatus.

FIG. 1 is a schematic view showing the image formation apparatus according to the embodiment of the invention, FIG. 2 is an axial cross-sectional view of a driven roller 22 used in the image formation apparatus, FIG. 3 is an enlarged view of a toner image-forming member 3 used in the image formation apparatus, and FIG. 4 is an enlarged view of the toner image-forming member 3 used in the image formation apparatus.

As shown in FIG. 1, in the image formation apparatus of this embodiment, there are provided four image-forming stations for respectively forming toner images of four colors, for example, black (K), yellow (Y), magenta (M) and cyan (C). Each of the image-forming stations includes a photosensitive drum (photosensitive member), serving as an image-carrying member, and the toner image-forming member 3 provided around the photosensitive drum 5 so as to form the toner image on the surface of the photosensitive drum 5.

The toner image-forming member 3, provided around each photosensitive drum 5, comprises a charger (charging means) 11 for electrifying the surface of the photosensitive drum 5 at a predetermined potential uniformly over an entire area thereof, an exposure device (exposure means) 12 for applying scanning lines of a laser beam, corresponding to specified color image data, to the charged photosensitive drum 5 to form an electrostatic latent image thereon, a developing device (developing means) 13 for developing the electrostatic latent image, formed on the photosensitive drum 5, by a developer such as a toner, a first transfer roller 21 for transferring the toner image, developed on the photosensitive drum 5, to an intermediate transfer belt 6 of the endless type, and a cleaner 14 for removing the residual toner remaining on the photosensitive drum 5 after the transfer of the toner image from the photosensitive drum 5 to the intermediate transfer belt 6.

The intermediate transfer belt 6, arranged along the plurality of photosensitive drums 5, are supported by a drive roller 20 for revolving the intermediate transfer belt 6, a driven roller 22, rotated in accordance with the revolution of the intermediate transfer belt 6, and a tension roller 28 which applies a tension to the intermediate transfer belt 6. The intermediate transfer belt 6 is revolved in a direction of arrow A in the illustrated embodiment.

The intermediate transfer belt 6 is made, for example, of an electrically-conductive polycarbonate resin to reduce the coefficient $\mu$ of friction between the intermediate transfer belt 6 and each photosensitive drum 5.

As shown in FIG. 2, the driven roller 22 is rotatably mounted on a driven roller shaft 23 through a torque limiter 24, which shaft is fixedly secured to a body of the apparatus. With this construction, a rotational load is applied to the driven roller 22.

In FIG. 1, the intermediate transfer belt 6 is disposed generally horizontally, and is held in contact with the photosensitive drums 5 without being pressed into the photosensitive drums 5 arranged in a series. Therefore, a frictional force, acting on an area B of contact between the photosensitive drum 5 and the intermediate transfer belt 6, is set to a value smaller than the tension of the intermediate transfer belt 6.

An intermediate transfer belt cleaner 27 for removing the residual toner, remaining on the surface of the intermediate transfer belt 6 after the transfer of the toner images to printing paper 7 by a second transfer roller 10, which will be described later, is provided adjacent to this belt 6.

A color drift sensor 29 for detecting the amount of a color misregistration or drift of the toner image, formed on the intermediate transfer belt 6 by the toner image-forming members 3, is provided adjacent to the intermediate transfer belt 6.

As described above, a black image, a cyan image, a magenta image and a yellow image are formed in the respective image-forming stations. Then, the single-color images thus formed on the respective photosensitive drums 5 are sequentially transferred onto the intermediate transfer belt 6 in superimposed relation to one another, thereby forming a full-color image.

A paper cassette 15, storing printing paper 7, is provided at a lower portion of the apparatus. The printing paper sheets 7 are fed one by one into a path of feed of the paper by a feed roller 16.

In the paper feed path, provided are resist rollers 17, which once stop the printing paper 7, traveling along the paper feed path, at a nip portion to control the transfer timing for the printing paper 7, the second transfer roller 10 held in contact with the outer peripheral surface of the intermediate transfer belt 6 over a predetermined region so as to transfer the color image, formed on the intermediate transfer belt 6, to the printing paper 7, and a fixing device 40 for fixing the transferred color image to the printing paper 7 by means of pressure and heat produced when a fixing roller 18 and a pressure roller 19 rotate while nipping the printing paper 7 therebetween.

This embodiment has been described, giving an example where conveyance means comprises the intermediate transfer belt 6 onto which the toner image, formed on each photosensitive drum 5, is transferred. The conveyance means, however, is not limited to this type, and even when a paper feed belt for feeding or conveying the printing paper 7 is used as the conveyance means, the same effect can be achieved. In this case, the printing paper 7, fed from the paper cassette 15, is fed or conveyed by the paper feed belt 6, and the printing paper 7 passes beneath each toner image-forming member 3, so that the toner image is transferred directly from the photosensitive drum 5 to the printing paper 7.

As shown in detail in FIG. 3, the first transfer roller 21 is rotatably mounted on a fixing member 31 of the apparatus through a shaft 30. The first transfer roller 21 is located at a position, spaced from the area B of contact between the associated photosensitive drum 5 and the intermediate transfer belt 6, and is held in press-contact with the intermediate transfer belt 6. With this arrangement, the coefficient p of friction between the photosensitive drum 5 and the intermediate transfer belt 6 is reduced.

In the image formation apparatus of this construction, for example, a latent image of a black color component of image information is first formed on the photosensitive drum 5 by the charger 11 and the exposure device 12 in the image-forming station corresponding to the black color. This latent image is formed into a visible image, serving as a black toner image, by the developing device 13 having a black toner, and this black toner image is transferred onto the intermediate transfer belt 6 by the first transfer roller 21.

During the time when the black toner image is being transferred to the intermediate transfer belt 6, a latent image of a cyan color component of the image information is formed in the image-forming station corresponding to the cyan color, and this latent image is developed as a cyan toner image by the developing device 13, using a cyan toner. Then, the cyan toner image is transferred by the first transfer roller 21 onto the intermediate transfer belt 6, to which the black toner image has already been transferred in the image-forming station corresponding to the black color, in superimposed relation to this black toner image.

Then, a magenta toner image and a yellow toner image are formed in the same manner as described above, and thus the toner images of the four colors are superimposed together on the intermediate transfer. belt 6. Thereafter, the printing paper 7 is fed from the paper cassette 15 by the feed roller 16, and the toner images of the four colors are transferred at a time onto the printing paper 7 by the second transfer roller 10, which paper is controlled in transfer timing by the resist rollers 17. The thus transferred toner images are heated and fixed to the printing paper 7 by the fixing roller 18 and the pressure roller 19, so that a full-color image is formed on this printing paper 7.

The residual toner is removed from each of the photosensitive drums 5 by the cleaner 14 after the transfer of the toner image therefrom is finished, so that the photosensitive drum 5 can be prepared for a subsequent image-forming operation.

Thus, in the apparatus including the plurality of image-forming stations, image information is projected onto each photosensitive drum 5 through scanning lines of a laser beam applied from the exposure device 12, and then this image information is formed into the visible image by the corresponding developing device 13, and the four visible images, thus formed, are sequentially transferred onto the same portion of the surface of the intermediate transfer belt 6 in superimposed relation to one another, which belt revolves in the direction of arrow A (in the drawings).

Here, provided that a press-contact force, applied between one photosensitive drum 5 and the intermediate transfer belt 6, is represented by P as shown in FIG. 3, and a coefficient of friction therebetween is represented by $\mu$, a frictional force F, exerted between the photosensitive drum 5 and the intermediate transfer belt 6, can be expressed by the formula, $F=\mu P$. Namely, the intermediate transfer belt 6 is kept generally horizontally without being pressed into the photosensitive drum 5, and therefore the press-contact forces P of the four photosensitive drums 5 relative to the intermediate transfer belt 6 are generally equal to one another.

Further, representing the radius of the driven roller 22 by R and a load torque by T, the tension Ft of the intermediate transfer belt 6 on the surface of the driven roller 22 can be expressed by the formula, Ft=TR. The belt tension Ft of the intermediate transfer belt 6 is set to a value larger than the value of the frictional force F (Ft>F).

As described above, each first transfer roller 21 is located at the position spaced from the area B of contact between the associated photosensitive drum 5 and the intermediate transfer belt 6, so that the coefficient $\mu$ of friction between the photosensitive drum 5 and the intermediate transfer belt 6 is reduced.

With this construction, even if a difference in peripheral speed develops between the photosensitive drum 5 and the intermediate transfer belt 6 and the frictional force F develops at the area B of contact therebetween, a slip occurs between the photosensitive drum 5 and the intermediate transfer belt 6 since the tension Ft of the intermediate transfer belt 6 is larger than this frictional force F, and therefore a speed variation of the photosensitive drum 5 will not be transmitted to the intermediate transfer belt 6.

Consequently, a speed variation of the intermediate transfer belt 6 due to a speed variation of the photosensitive drum 5 can be reduced.

As shown in FIG. 4, the first transfer roller 21, located at a position spaced from the area B of contact between the associated photosensitive drum 5 and the intermediate transfer belt 6, may be held in press-contact with the intermediate transfer belt 6 by a tension member 32.

Also in this construction, a speed variation of the photosensitive drum 5 will not be transmitted to the intermediate transfer belt 6, and therefore a speed variation of the intermediate transfer belt 6 due to a speed variation of the photosensitive drum 5 can be reduced.

As described above, according to the invention, even when a peripheral speed difference develops between the photosensitive member and the intermediate transfer belt to cause a frictional force between their contacting portions, a slip occurs between the photosensitive member and the intermediate transfer belt since the tension of the intermediate transfer belt is larger than this frictional force,. and a speed variation of the photosensitive member will not be transmitted to the intermediate transfer belt. Therefore, provided is a meritorious effect that a speed variation of the intermediate transfer belt due to a speed variation of the photosensitive member can be reduced.

Consequently, there is achieved an advantage that a color drift due to a speed variation of the intermediate transfer belt can be reduced, thereby providing a high-grade image.

Another embodiment of the invention will now be described with reference to FIGS. 5 to 7. Those members, identical to those of the first embodiment, will be designated by identical reference numerals, and repeated explanation thereof will be omitted.

Figure 5:
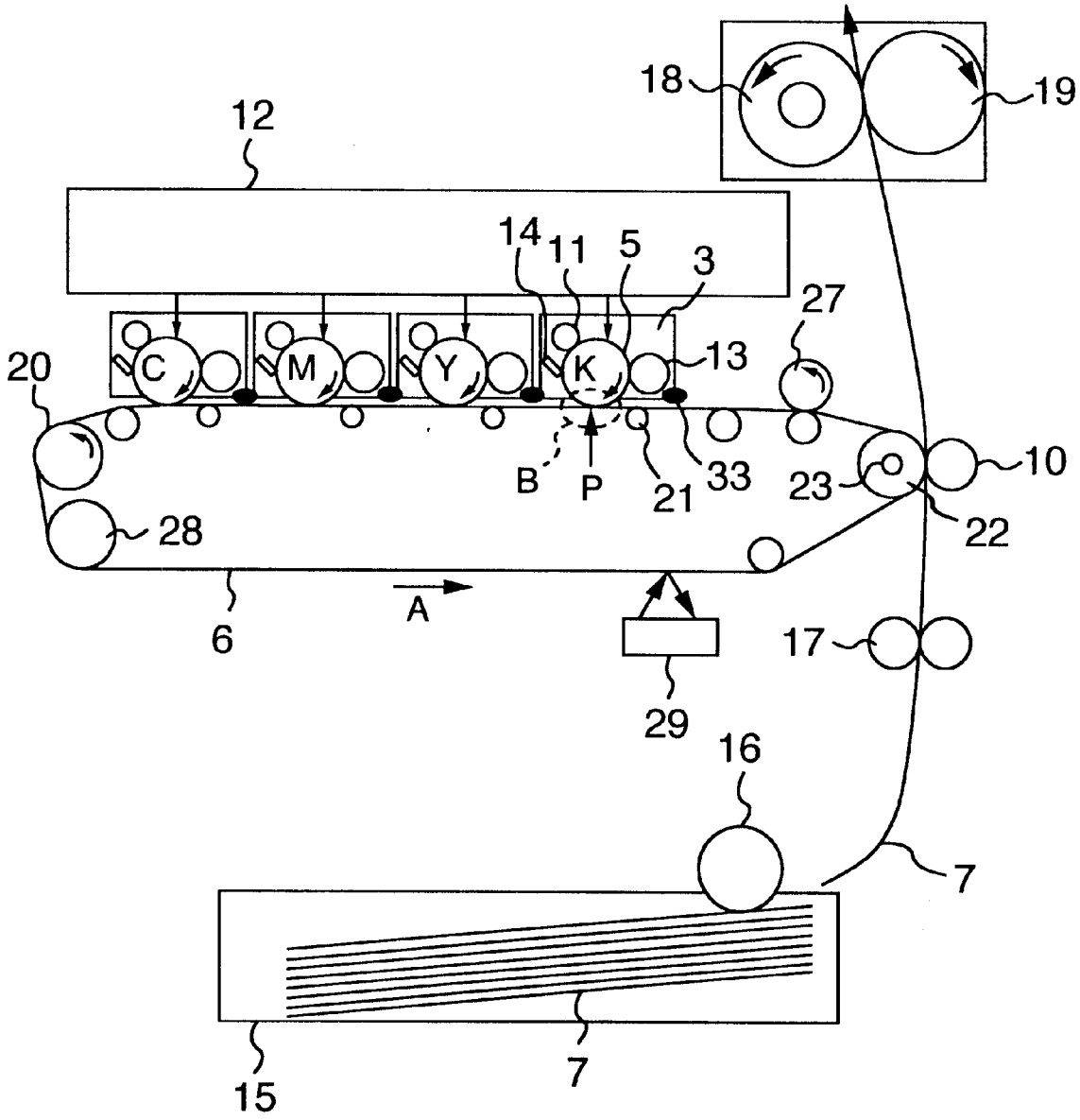
FIG. 5 is a schematic view showing an image formation apparatus according to another embodiment of the invention.
Figure 6:
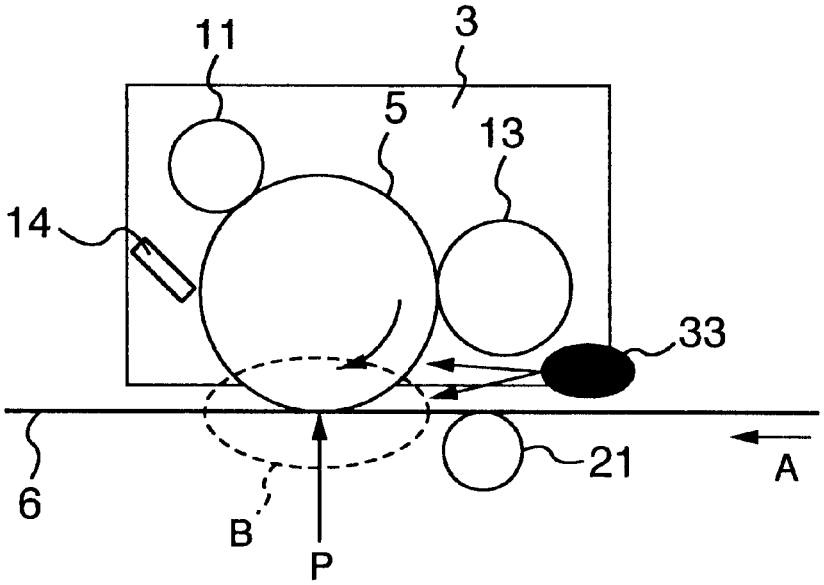
FIG. 6 is an enlarged view of a toner image-forming member used in the image formation apparatus.
Figure 7:
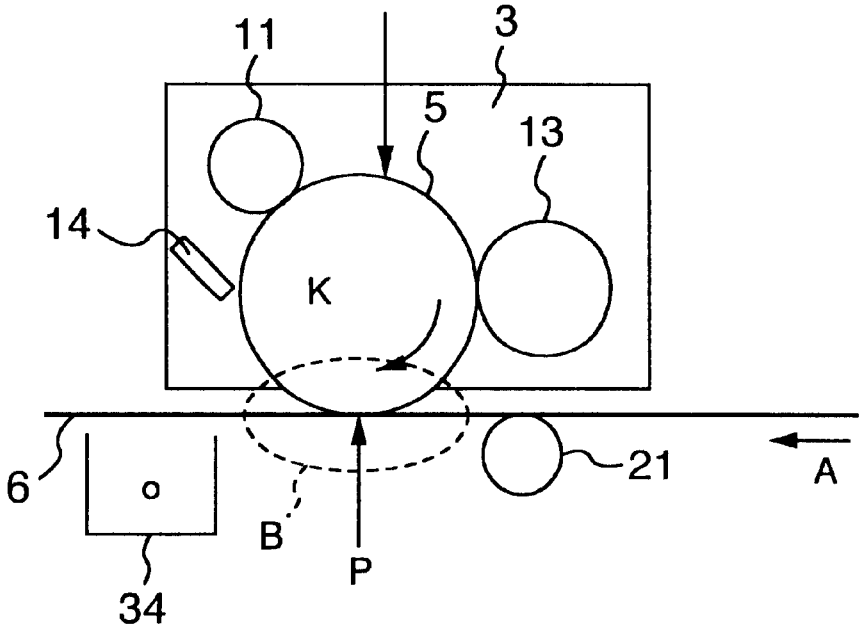
FIG. 7 is an enlarged view of the toner image-forming member used in the image formation apparatus.
Figure 8:
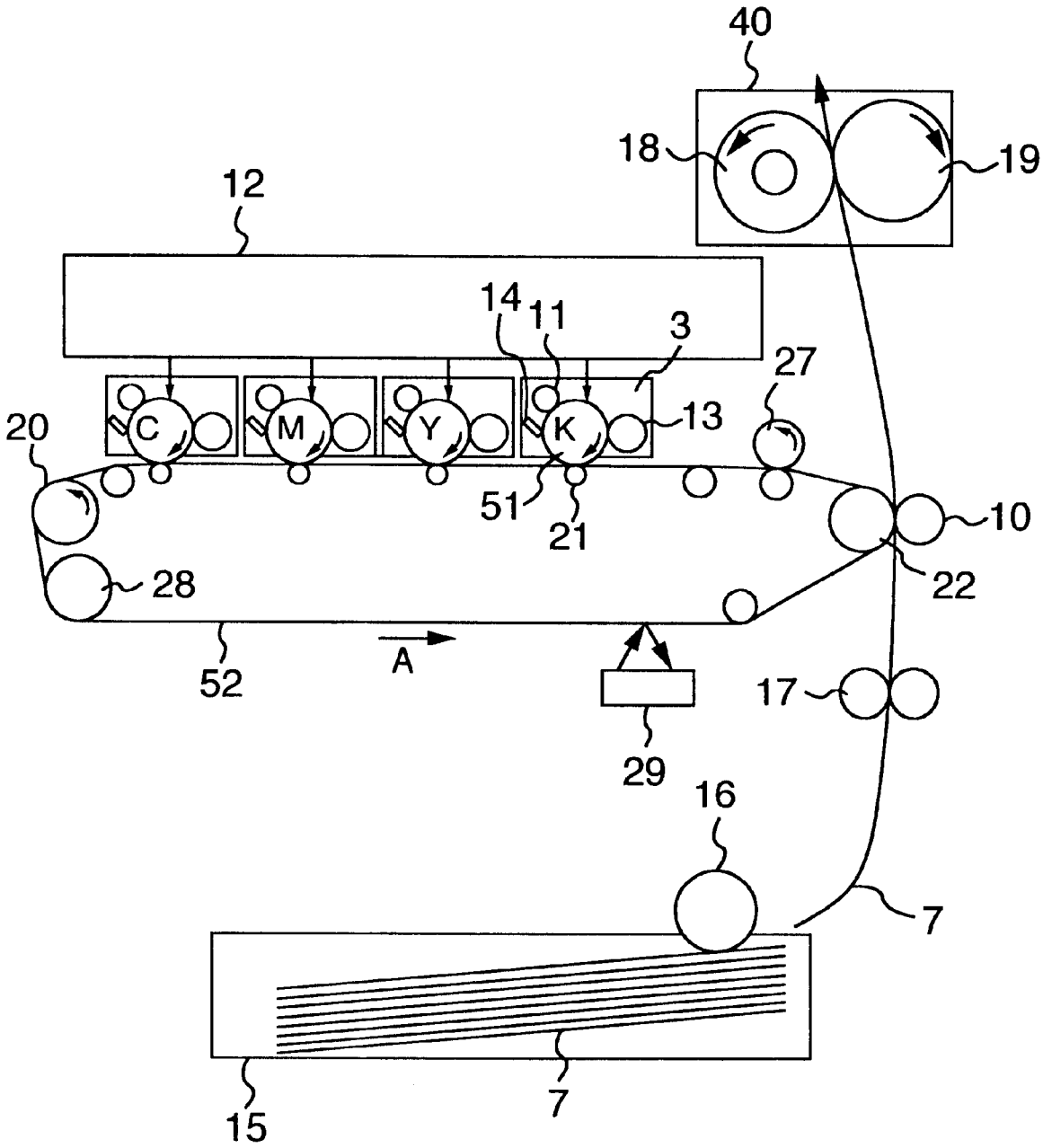
FIG.8 PRIOR ART
FIG. 8 is a schematic view showing a conventional image formation apparatus.

FIG. 5 is a schematic view showing the image formation apparatus according to the other embodiment of the invention, FIG. 6 is an enlarged view of a toner image-forming member 3 used in the image formation apparatus, and FIG. 7 is an enlarged view of the toner image-forming member 3 used in the image formation apparatus.

Referring to FIG. 5, the toner image-forming member 3 includes an electricity-removing lamp 33, which is shown in detail in FIG. 6. In FIG. 6, the electricity-removing lamp (electricity-removing means) 33 is provided for applying light to the outer peripheral surface of a photosensitive drum 5 at a position where the drum has contacted with a developing device 13 and is advancing to an area B of contact with an intermediate transfer belt 6, to decrease the surface potential of the photosensitive drum 5. The lowering of the surface potential of the photosensitive drum 5 by the electricity-removing lamp 33 reduces an electrostatic attracting force between the photosensitive drum 5 and the intermediate transfer belt 6, so that a frictional force, acting on the area B of contact between the photosensitive drum 5 and the intermediate transfer belt 6 becomes smaller than the tension of the intermediate transfer belt 6.

The intermediate transfer belt 6, arranged along the plurality of photosensitive drums 5, are supported by a drive roller 20 for revolving the intermediate transfer belt 6, a driven roller 22, rotated in accordance with the revolution of the intermediate transfer belt 6, and a tension roller 28 which applies a tension to the intermediate transfer belt 6. The intermediate transfer belt 6 is revolved in a direction of arrow A in the illustrated embodiment.

The intermediate transfer belt 6 is made, for example, of an electrically-conductive polycarbonate resin to reduce the coefficient $\mu$ of friction between the intermediate transfer belt 6 and each photosensitive drum 5. The driven roller 22 is rotatably mounted on a driven roller shaft 23 fixedly secured to a body of the apparatus.

The peripheral speed of the intermediate transfer belt 6 is set to be higher than the peripheral speed of each photosensitive drums 5. Further, the peripheral speed of the upstream-side one of any two adjacent photosensitive drums 5 in the direction of travel of the intermediate transfer belt 6 is set to be lower than the peripheral speed of the downstream-side one. And besides, the peripheral speed of the intermediate transfer belt 6 is set to be higher than the peripheral speeds of the photosensitive drums 5 obtained when speed variations of the photosensitive drums 5 due to variations in the outer diameters thereof and deviations of the axes thereof are maximum.

Provided that an electrostatic attracting force, applied between one photosensitive drum 5 and the intermediate transfer belt 6, is represented by P, and that a coefficient of friction therebetween is represented by $\mu$, a frictional force F, exerted between the photosensitive drum 5 and the intermediate transfer belt 6, can be expressed by the formula, $F=\mu P$. And, representing the radius of the driven roller 22 by R and a load torque by T, the tension Ft of the intermediate transfer belt 6 on the surface of the driven roller 22 can be expressed by the formula, Ft=TR. The belt tension Ft of the intermediate transfer belt 6 is larger than the value of the frictional force F (Ft>F) as described above.

With this construction, even if a difference in peripheral speed develops between one of the photosensitive drums 5 and the intermediate transfer belt 6 and the frictional force F develops at the area B of contact therebetween, a slip occurs between the photosensitive drum 5 and the intermediate transfer belt 6 since the tension Ft of. the intermediate transfer belt 6 is larger than this frictional force F, and a speed variation of the photosensitive drum 5 will not be transmitted to the intermediate transfer belt 6.

Therefore, a sag or dip of the intermediate transfer belt 6 between any two adjacent photosensitive drums 5 is reduced.

As shown in FIG. 7, instead of the electricity-removing lamp 33 shown in FIG. 6, an AC corona discharge member (charge-neutralizing means) 34 may be provided, which neutralizes electric charges of the photosensitive drum 5 and the intermediate transfer belt by a corona discharge. In this case, the electric charges of the photosensitive drum 5 and the intermediate transfer belt 6 are neutralized, and thereby a sag or dip of the intermediate transfer belt 6 between any two adjacent photosensitive drums 5 is reduced.

As described above, the invention offers a meritorious result that a sag or dip of the intermediate transfer belt between any two adjacent photosensitive members can be reduced.

Therefore, there is achieved an advantage that a color drift due to a speed variation of each photosensitive member can be reduced, so that a high-grade image can be obtained.

Another aspect of the second embodiment of the invention will be described with reference to FIG. 5. Those members, identical to those of the first embodiment, will be designated by identical reference numerals, and repeated explanation thereof will be omitted.

In FIG. 5, as described above, the peripheral speed of the intermediate transfer belt 6 is higher than the peripheral speeds of the photosensitive drums 5. Further, the peripheral speed of the upstream-side one of any two adjacent photosensitive drums 5 in the direction of travel of the intermediate transfer belt 6 is lower than the peripheral speed of the downstream-side one. And besides, the peripheral speed of the intermediate transfer belt 6 is higher than the peripheral speeds of the photosensitive drums 5 obtained when a speed variation of the photosensitive drums 5 due to a variation in the outer diameter thereof and a deviation of the axis thereof is maximum.

With this construction, even when a difference in peripheral speed develops between one of the photosensitive drums 5 and the intermediate transfer belt 6 and the frictional force F develops at the area B of contact therebetween, a slip occurs between the photosensitive drum 5 and the intermediate transfer belt 6 since the tension Ft of the intermediate transfer belt 6 is larger than this frictional force F, and a speed variation of the photosensitive drum 5 will not be transmitted to the intermediate transfer belt 6.

Therefore, a sag or dip of the intermediate transfer belt 6 between any two adjacent photosensitive drums 5 is reduced.

Further, the peripheral speed of the upstream-side one of any two adjacent photosensitive drums 5 in the direction of travel of the intermediate transfer belt 6 is lower than that of the downstream-side one. Therefore, a slip develops between the photosensitive drum 5 and the intermediate transfer belt 6, and a speed variation of the photosensitive drum 5 will not be transmitted to the intermediate transfer belt 6.

With this construction, a sag or dip of the intermediate transfer belt 6 between any two adjacent photosensitive drums 5 is further reduced.

Furthermore, the peripheral speed of the intermediate transfer belt 6 is higher than the peripheral speeds of the photosensitive drums 5 obtained when speed variations of the photosensitive drums 5 due to variations in the outer diameters thereof and deviations of the axes thereof are maximum, and therefore a slip develops between each photosensitive drum 5 and the intermediate transfer belt 6, so that a speed variation of the photosensitive drum 5 will not be transmitted to the intermediate transfer belt 6.

With this construction, a sag or dip of the intermediate transfer belt 6 between any two adjacent photosensitive drums 5 is further reduced.

As described above, the invention provides a meritorious result that a sag or dip of the intermediate transfer belt between any two adjacent photosensitive members can be reduced.

Accordingly, there is achieved an advantage that a color drift due to speed variations of the photosensitive members can be reduced, so that a high-grade image can be obtained.

Because of lowering the peripheral speed of the upstream-side one of any two adjacent photosensitive members in the direction of travel of the intermediate transfer belt than that of the downstream-side one, it is possible to have a meritorious result that a sag or dip of the intermediate transfer belt between any two adjacent photosensitive members can be further reduced.

Thanks to setting the peripheral speed of the intermediate transfer belt is higher than those of the photosensitive members obtained when speed variations of the photosensitive members are maximum, it is possible to have a meritorious result that a sag or dip of the intermediate transfer belt between any two adjacent photosensitive members can be further reduced.

What is claimed is:

1. An image formation apparatus comprising a plurality of image-carrying members each for carrying an image formed by a developer, and conveyance means provided in opposed relation to said image-carrying members, rotational speeds of said image carrying members being set such that the image-carrying member disposed more upstream in a direction of conveyance of said conveyance means has a lower speed.

2. An image formation apparatus according to claim 1, wherein a peripheral speed of said conveyance means is higher than peripheral speeds of said image-carrying members obtained when speed variations of said image-carrying members are maximum.

3. An image formation apparatus according to claim 1, wherein said conveyance means is capable of conveying developed images transferred thereto respectively from said image-carrying members.

4. An image formation apparatus according to claim 1, wherein said conveyance means is capable of conveying a printing medium.

5. An image formation apparatus comprising a plurality of photosensitive members each for carrying an image formed by a developer, and an intermediate transfer member provided in opposed relation to said photosensitive members, said photosensitive members having rotational speeds set such that the photosensitive member disposed more upstream in a direction of conveyance of said intermediate transfer member has a lower speed.

6. An image formation apparatus according to claim 5, wherein said intermediate transfer member has a peripheral speed that is higher than peripheral speeds of said photosensitive members at a time when speed variations of said photosensitive members are maximum.

7. An image formation apparatus comprising a plurality of photosensitive members each for carrying an image formed by a developer, and a conveyance belt or drum provided in opposed relation to said photosensitive members for conveying a printing medium, said photosensitive members having rotational speeds set such that the photosensitive member disposed more upstream in a direction of conveyance of said conveyance belt or drum has a lower speed.

8. An image formation apparatus according to claim 7, wherein said conveyance belt or drum has a peripheral speed that is higher than peripheral speeds of said photosensitive members at a time when speed variations of said photosensitive members are maximum.

* * * * *